US005103517A

United States Patent [19]

Krouskop

[11] Patent Number: 5,103,517

[45] Date of Patent: Apr. 14, 1992

[54] DISPOSABLE SURGICAL PAD

[75] Inventor: Thomas A. Krouskop, Stafford, Tex.

[73] Assignee: The Institute for Rehabilitation and Research, Houston, Tex.

[21] Appl. No.: 568,158

[22] Filed: Aug. 18, 1990

[51] Int. Cl.[5] ..... A47C 27/08

[52] U.S. Cl. ..... 5/450; 5/453

[58] Field of Search ..... 5/434, 438, 450, 455, 5/457, 448, 487

[56] References Cited

U.S. PATENT DOCUMENTS

| | | | |
|---|---|---|---|
| 2,552,476 | 5/1951 | Barton | 155/182 |
| 2,667,915 | 2/1954 | Pfeffer et al. | 155/182 |
| 2,707,289 | 3/1955 | Taggart | 5/354 |
| 3,017,642 | 1/1962 | Rosenberg et al. | 5/450 X |
| 3,170,172 | 2/1965 | Kessman | 5/457 |
| 3,308,491 | 3/1967 | Spence | 5/348 |
| 3,428,973 | 2/1969 | Hargest | 5/450 |
| 3,548,420 | 12/1970 | Spence | 3/20 |
| 3,608,961 | 9/1971 | Von Heck | 297/284 |
| 3,689,945 | 9/1972 | Laerdal . | |
| 4,139,920 | 2/1979 | Evans | 5/455 |
| 4,152,796 | 5/1979 | Fogel | 5/457 X |
| 4,163,297 | 8/1979 | Neumark | 5/455 X |
| 4,213,213 | 7/1980 | Burnett | 5/450 |
| 4,214,576 | 7/1980 | Healey | 128/24.1 |
| 4,254,518 | 3/1981 | Buhren et al. | 5/450 |
| 4,371,997 | 2/1983 | Mattson | 5/450 |
| 4,425,676 | 1/1984 | Crane | 5/450 |
| 4,577,358 | 3/1986 | Glass | 5/455 |
| 4,607,403 | 8/1986 | Alivizatos | 5/455 X |
| 4,637,377 | 1/1987 | Loop | 128/1 R |
| 4,644,597 | 2/1987 | Walker | 5/455 X |

FOREIGN PATENT DOCUMENTS

| | | | |
|---|---|---|---|
| 934078 | 9/1973 | Canada | 5/450 |
| 3524088 | 1/1986 | Fed. Rep. of Germany | 5/434 |
| 17534 | of 1888 | United Kingdom | 5/448 |
| 3535 | of 1914 | United Kingdom | 5/448 |
| 1454292 | 11/1976 | United Kingdom | 5/450 |
| 1590583 | 6/1981 | United Kingdom | 5/431 |

*Primary Examiner*—Renee S. Luebke
*Assistant Examiner*—Michael J. Milano
*Attorney, Agent, or Firm*—Fulbright & Jaworski

[57] ABSTRACT

A disposable surgical pad for supporting a patient having a cellulose housing with a granular cellulose material in the cavity of the housing. The granular material is generally uniformly shaped, preferably spheroid in shape, and of a size for assuming a shape to conform to a patient without packing together and of a size which is substantially radio-translucent. A valve is connected to the housing for controlling the air pressure in the cavity whereby the granular material will create a custom contoured support.

5 Claims, 3 Drawing Sheets

DISPOSABLE SURGICAL PAD

BACKGROUND OF THE INVENTION

The present invention is directed to a single use pad that can be used in an operating room environment to redistribute weight from areas of a patient that are typically at high risk of breakdown during surgical procedures. The pad will also serve as a means of posturing the patient during a surgical procedure.

The components of the pad are biodegradable and preferably incineratable without creating environmental problems, but meet the flamability standards for operating room equipment. In addition, the pad or mattress utilizes granular cellulose based filler material of generally uniform shape and size for assuming a shape to conform to the patient without packing together and of a size which does not significantly interfere with x-ray transmission. Means are provided in the pad cover for controlling the air pressure in the cells of the support surface for fluidizing the granular material to conform to the shape of the patient and to reduce the air pressure in the cells to provide a semi-rigid shaped support for the patient.

There are a multitude of mattresses and similar support devices for a human body in which the mattress contains a particulate material which under air pressure will conform with the configuration of the body being supported and which, when the air pressure is reduced, will more rigidly support the body. However, these devices generally included plastic components and were not suitable for use in surgical environments. First, patient support media in an operating room environment are subject to contamination, and should be not only biodegradable, but burnable without creating any environmental problems, and still meet the standards for flamability of operating room equipment. Secondly, the filler material used in the pad or mattress should be of a consistency that is substantially radio-translucent, and thereby provides minimal interference with x-ray imaging. In this regard, many plastic materials are not sufficiently x-ray transparent. In addition, the material should be a size to be as coarse as possible so that it will not pack and reduce its capacity to mold and provide pressure relief for the body, but must be easily fluidized with air so that it will produce a custom contoured surface for the person to lie after the excess air is removed from the pad.

SUMMARY

The present invention is directed to a disposable surgical pad for supporting a patient and includes a housing enclosing a cavity in which the housing includes a cellulose material. A granular cellulose material is positioned in the cavity and is of a generally uniformly shape for reducing its tendency to pack together. In addition the granular material is of a size for assuming a shape to conform to a patient without packing together. If desired the granular material may be of a small enough size which is substantially radio-translucent. Means are provided in the housing for making connections for controlling the air pressure in the cavity, for fluidizing the granular material, for allowing it to conform to the contour of a person and which will, when the pressure is reduced, provide a semi-rigid support contoured surface that stabilizes the patient as well as provides pressure relief to the patient.

Still a further object of the present invention is wherein the granular cellulose material is generally spherical for reducing its tendency to compact and stick together.

A further object of the present invention is wherein the housing is gas permeable whereby a vacuum may be applied on the inside of the housing for keeping the granular material firm, and thereby providing a stabilizing support.

Another object of the present invention is wherein the housing consists of a paper which is not only biodegradable, but is burnable without creating any environmental problems, and which will meet the standards for flamability of the operating room.

Yet a further object of the present invention is wherein the granular material is selected from a group consisting of nut shells, corn cobs, and grain hulls, which, like the housing are not only biodegradable, but are burnable without adverse environmental consequences. Preferably, the size of the granular material is substantially between 90 and 224 mesh. This range provides a fine, non-cohesive, granular material which will not interfere significantly with x-rayed materials. However, the granular material is as coarse as possible so that it will not pack and reduce its capacity to be moved and provide pressure relief for the patient. This size material can be easily fluidized with air so that it will produce a custom contoured surface for the person to lie on after the air is removed from the pad.

Still a further object of the present invention is wherein the housing includes a plurality of longitudinally extending partitions for reducing transverse flow of the granular material. This will avoid the patient bottoming out on the pad. Various types of partitions may be provided for performing this function.

Other and further objects, features and advantages will be apparent from the following description of presently preferred embodiments of the invention, given for the purpose of disclosure and taken in conjunction with the accompanying drawings.

DESCRIPTION OF THE PREFERRED EMBODIMENTS

Figure 1:
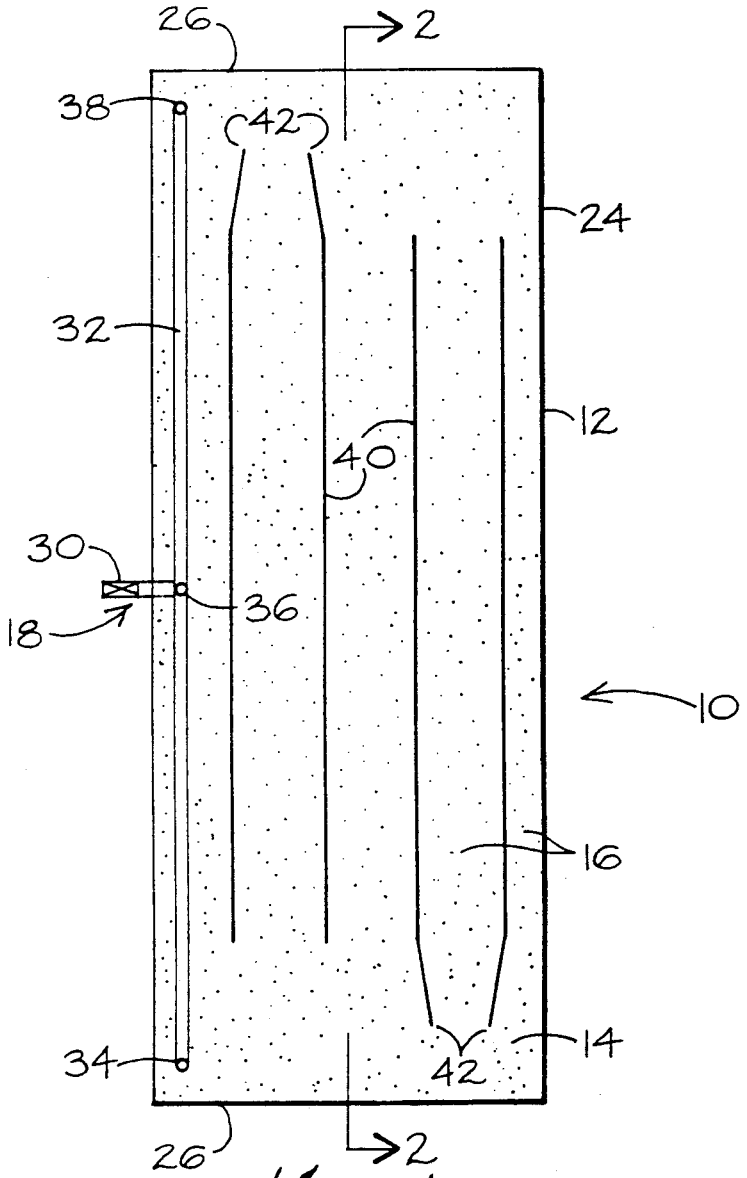
FIG. 1 is an elevational view of the surgical pad or mattress of the present invention with the top removed.
Figure 2:
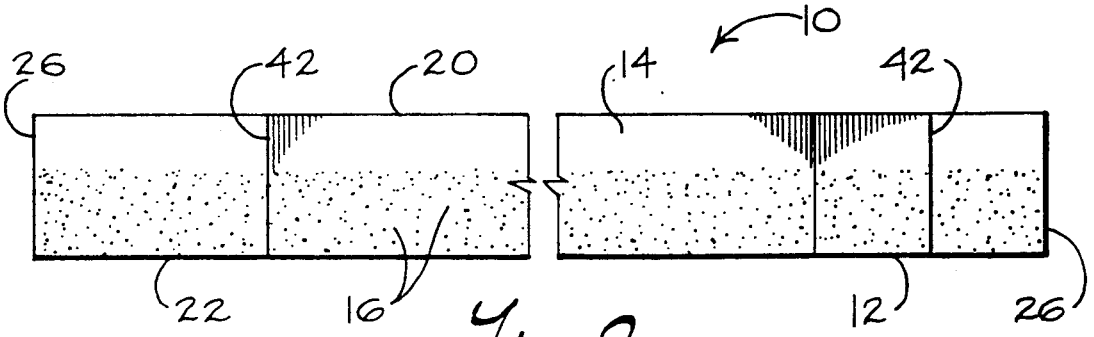
FIG. 2 is a cross-sectional view taken along the line 2—2 of FIG. 1.

Referring now to the drawings, and particularly to FIGS. 1 and 2, the reference numeral 10 generally indicates the surgical pad or mattress of the present invention for supporting a patient thereon. The pad 10 generally includes a housing 12, a cavity 14, a granular cellulose material 16 in the cavity 14 and means 18 connected to the housing 12 for controlling the air pressure in the cavity 14.

The housing 12 consists of a top 20, a bottom 22, sides 24 and ends 26. The housing 12 consists of any suitable cellulose material, preferably paper, and is biodegradable, and meets the standards for flamability of operating room devices. That is, the paper housing 12 will not independently support burning, but may be incinerated without creating environmental problems. In addition, the paper is flexible, and preferably gas permeable. For example only, the housing 12 may be of a size 30" by 78" and 3½" thick and comprised of a plurality of layers of paper to provide the desirable strength, but flexibility to conform to the contour of a patient's body. For example, the housing 12 may be comprised of up to 6 layers of paper of up to 6 mils thick each.

The granular cellulose material 16 is supplied in the cavity 14 in a sufficient quantity to prevent the patient from inadvertently bottoming out on the bottom 22, but with a small enough volume that the granular material can be moved inside the housing 12 to create a custom contoured support that will relieve the contact pressures under the boney areas of the patient. For example only, the granular material 16 may be of a volume to fill the cavity 14 approximately two-thirds full. The granular material 16 should be a fine, non-cohesive, granular material. In order for the cellulose granular material not to interfere significantly with x-ray procedures, the material 16 should be fine enough so as to be substantially radio-translucent. The granular material 16, however, should be as coarse as possible so that it will not pack, stick together, or reduce its capacity to be moved and provide pressure relief for the patient's body. The size of the particles should be no greater than those that will pass through a 90 mesh screen thereby insuring that the cellulose particles will be radio-translucent. In addition, particle 16 should not be any smaller than those that will be stopped by a 224 mesh screen in order to prevent them from becoming packed and immobile. If it not desired that the granular material 16 be radio-translucent, then size of the granular particles may be greater than those that would pass through a 90 mesh screen.

Another feature of the granular cellulose material particle 16 is that they should be generally uniformly shaped. For example, it is preferable that the particle 16 be of a generally spheroid in shape which will further insure that they are non-cohesive, will not stick together and become packed. Thus, the granular material is provided in shape and size so that it can be as coarse as possible so that it will not pack and reduce its capacity to be moved, but on the other hand is of a small enough size so as to produce minimal background interference with x-ray imaging, if desired. Therefore, the granular particles 16 can be easily fluidized with air so that it will produce a custom contoured surface for the person to lie on and will provide a semi-rigid support after air is removed from the pad. Vacuum can be applied to maintain the contoured shape of the granular material. In addition, the granular material 16 of cellulose material, is sized and shape so that it will not produce air borne dust if the housing 12 is torn.

While the granular material 16 may be of any suitable cellulose material, in prototype work ground walnut shells and ground corn cobs have been found to be satisfactory. Other particular types of satisfactory material may be other nut shells such as pecan shells, hickory shells and pistachio shells. Other types of hulls may also be satisfactory such as rice hulls and wheat hulls. In any event, cellulose materials such as the housing 12 and granular material 16 are not only biodegradable, but may be incinerated without creating environmental problems, which is important in disposing of surgical pads 10 which have been subjected to infection, diseases, body fluids, or other contamination.

The means 18 connected to the housing is for the purpose of controlling the air pressure in the cavity 14. The means 18 may include a valve 30 connected to a manifold 32 having openings 34, 36, and 38 in communication with the cavity 14 for increasing or decreasing the air pressure in the cavity 14 in the housing 12. Standard operating room air supplies or vacuum lines may be connected to the valve 30. Thus, atmospheric or positive air pressure may be applied to the granular material 16 for fluidizing it so that it may be easily moved to produce a custom contoured surface for the patient to lie on. Thereafter, the air may be removed, and a vacuum applied to the valve 30, if desired, to place the contoured material 16 in a semi-rigid condition coacting with the contour of the patient's body. In this operating mode, the material 16 will become a semi-rigid support surface that stabilizes the patient as well as providing pressure relief to the patient's body.

While the housing 12 may be comprised of a single compartment or a plurality of separate compartments having granular material 16 and in communication with the valve 30, it is preferable to provide a plurality of longitudinally extending partitions 40 in the housing 12 for reducing the transverse flow of the granular material 16 as a patient is laid on the housing 12. That is, with a single large compartment of fluidized particles 16, the body of a patient would tend to displace the fluidized particles 16 and have a tendency to bottom out on the bottom 22 which is undesirable. Therefore, the partitions 40 reduce the movement of the granular particles 16 for reducing the tendency for a patient to bottom out. The partitions 40 include ends 42 which are spaced from the ends 26 of the housing whereby the ends 42 are in communication with the air pressure control means 18 for pressurizing and removing air throughout the cavity 14.

Figure 3:
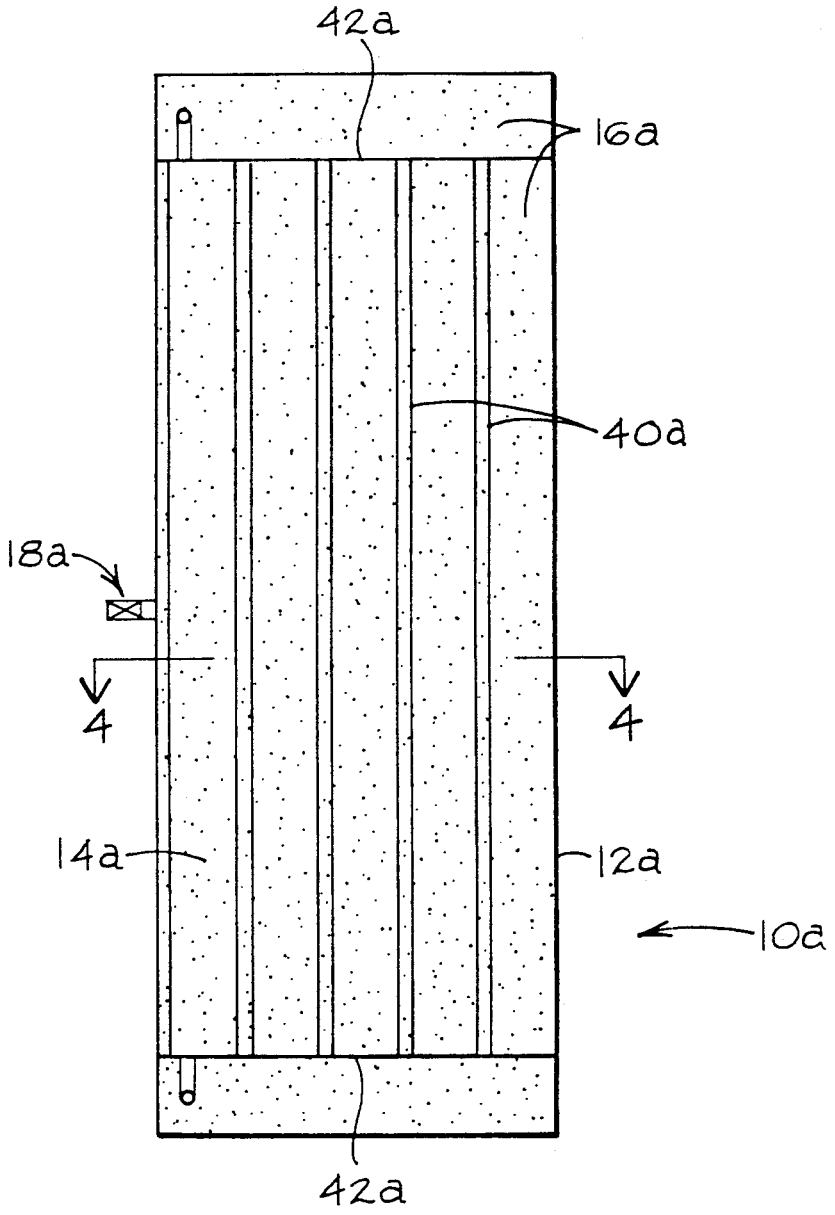
FIG. 3 is another embodiment of a surgical pad of the present invention shown in elevational view with a top removed.
Figure 4:
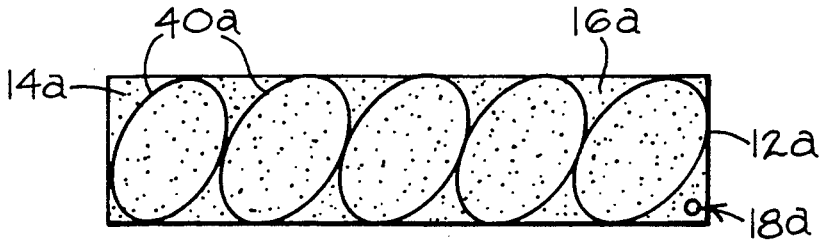
FIG. 4 is a cross-sectional view taken along the line 4—4 of FIG. 3.
Figure 5:
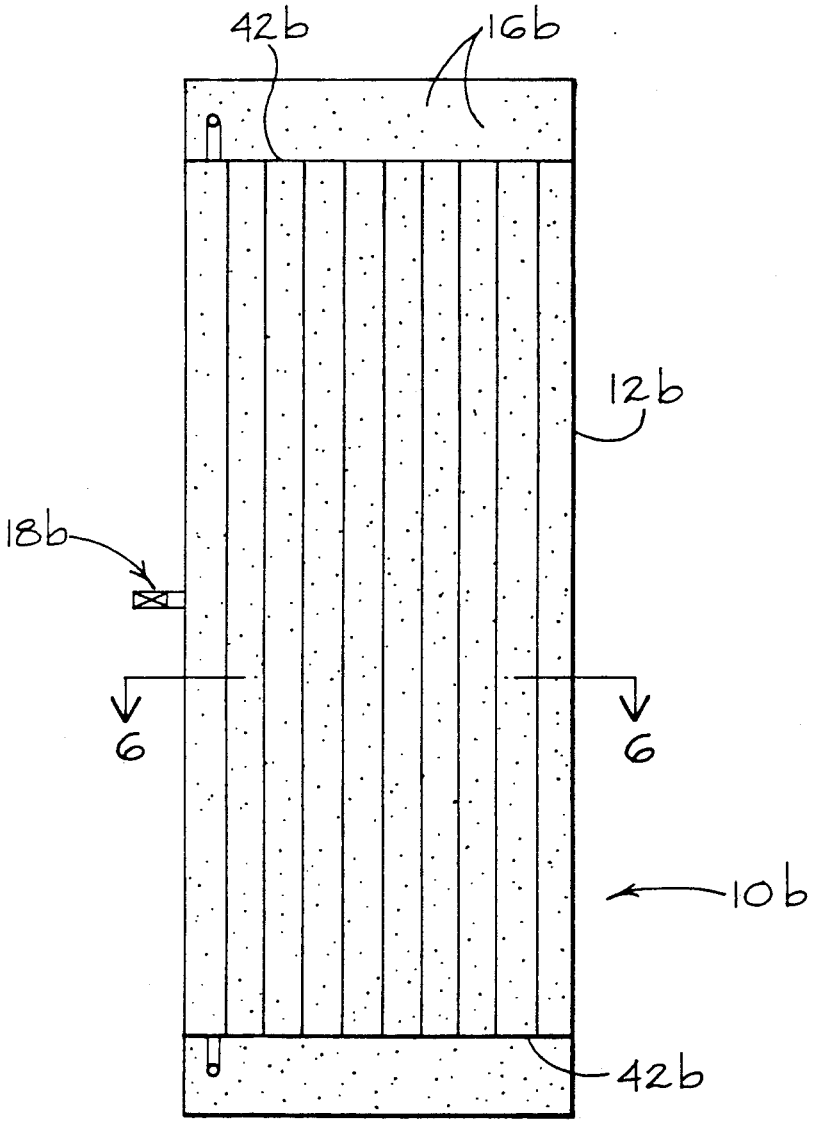
FIG. 5 is still another embodiment of the pad of the present invention with the top removed.
Figure 6:
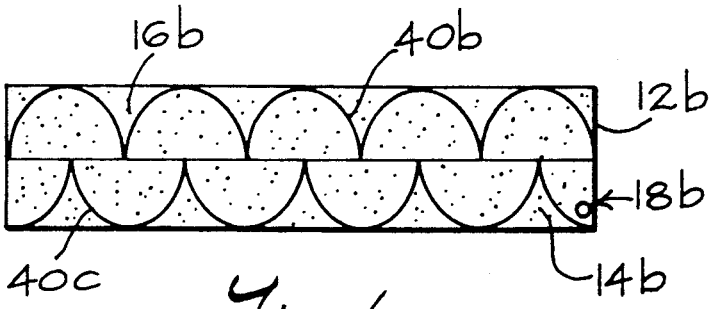
FIG. 6 is a cross-sectional view taken along the line 6—6 of FIG. 5.

Other and further embodiments of the shape of the housing 12 may be provided wherein like parts to those shown in FIGS. 1 and 2 include the suffix "a" in FIGS. 3 and 4 and the suffix "b" in FIGS. 5 and 6. In FIGS. 3 and 4 longitudinally extending partitions **40*a* are in the form of tubular members having a generally egged shaped cross-section. In addition, the cross-sections are at an angle to the vertical in order to prevent seams between the partitions 40*a* from creating "hard spots" in the housing 12*a***.

Similarly, referring to FIGS. 5 and 6, the longitudinally extending partitions **40*b* consist of upper semi-circular partitions 40*b* and lower semi-circular partitions 40*c* with the partitions 40*b* and 40*c* being offset from each other to prevent seams there between creating hard spots in the housing 12*b***.

The present invention provides a disposable surgical pad which can provide a single use product, which is composed of all biodegradable materials, and which in fact may be incinerated without creating environmental problems while disposing of potentially hazardous materials, is burnable, but will not support burning independently and therefore will meet operating room standards, will not interfere with taking of x-rays and includes a filler material of a size and shape which will provide pressure relief for the soft tissue of a patient as well as stability for the patient.

The present invention therefore, is well adapted to carry out the objects and attain the ends and advantages mentioned as well as others inherent therein. While presently preferred embodiments of the invention have been given for the purpose of disclosure, numerous changes in the details of construction and arrangement of parts, will be readily apparent to those skilled in the art which are encompassed within the spirit of the invention and the scope of the appended claims.

What is claimed is:

1. A disposable surgical pad for supporting a horizontally positioned body of a patient comprising, a biodegradable incineratable paper housing enclosing a cavity, a non-cohesive, granular cellulose material in the cavity, said granular material being generally uniformly shaped in size to be large enough not to pack together, but small enough not to interfere with the interpretation of x-rays, the size of the granular material being substantially between 90 and 224 mesh, a plurality of longitudinally extending partitions positioned in the housing for reducing transverse flow of the granular material in the housing, and said housing being gas permeable for allowing the passage of gas therethrough for providing a custom-contoured surface for the patient.

2. The surgical pad of claim 1 including pressurizing means connected to the housing for controlling the air pressure in the cavity.

3. The surgical pad of claim 1 wherein the ends of the partition are spaced from the ends of the housing for allowing the passage of air around the partitions.

4. The surgical pad of claim 1 wherein the granular material is selected from a group consisting of nut shells, corn cobs and grain hulls.

5. The surgical pad of claim 1 wherein the granular cellulose material is generally spheroid.

* * * * *